US011149399B2

(12) United States Patent
Wang et al.

(10) Patent No.: US 11,149,399 B2
(45) Date of Patent: Oct. 19, 2021

(54) TRACK-TYPE JET GROUTING INTEGRATED SYSTEM

(71) Applicants: Infrastructure Renewal Institute of Southern China, Guangdong (CN); WELEAD Infrastructure Engineering Technology (Zhengzhou), Ltd., Henan (CN)

(72) Inventors: Fuming Wang, Guangdong (CN); Hongyuan Fang, Guangdong (CN); Peng Zhao, Henan (CN); Yanhui Pan, Henan (CN); Xianfeng Zhao, Henan (CN); Yingli Wang, Henan (CN)

(73) Assignees: Infrastructure Renewal Institute of Southern China., Guangdong (CN); WELEAD Infrastructure Engineering Technology (Zhengzhou), Ltd., Henan (CN)

( * ) Notice: Subject to any disclaimer, the term of this patent is extended or adjusted under 35 U.S.C. 154(b) by 0 days.

(21) Appl. No.: 16/858,723

(22) Filed: Apr. 27, 2020

(65) Prior Publication Data

US 2020/0256030 A1 Aug. 13, 2020

(30) Foreign Application Priority Data

Aug. 30, 2019 (CN) ..... 201910818542.2

(51) Int. Cl.

| | |
|---|---|
| ***E02D 15/02*** | (2006.01) |
| ***E02D 29/02*** | (2006.01) |
| ***E02D 31/02*** | (2006.01) |

(52) U.S. Cl.
CPC ..... *E02D 15/02* (2013.01); *E02D 29/0275* (2013.01); *E02D 31/02* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 5,803,964 | A * | 9/1998 | Scarborough | E04B 1/161 | 106/724 |
| 5,851,580 | A * | 12/1998 | Amberg | E21D 11/105 | 427/8 |
| 5,976,632 | A * | 11/1999 | Gerber | B05B 7/1431 | 427/426 |
| 2006/0055193 | A1* | 3/2006 | Colborne | B60P 3/14 | 296/24.3 |
| 2011/0186657 | A1* | 8/2011 | Haviland | F41B 9/0087 | 239/722 |

(Continued)

*Primary Examiner* — Kyle Armstrong

(57) ABSTRACT

A track-type shotcrete integrated system includes: a proportioner working bin, a storage bin, a power bin, and load-bearing legs, wherein bottom sections of the load-bearing legs are equipped with a track chassis for moving, and the track chassis is electrically connected to a track controller; the storage bin contains a storage tank I and a storage tank II for storing different raw materials; a feed pump I is installed on a top of the storage tank I, and a feed pump II is installed on a top of the storage tank II; inlet pipes of the feed pump I and the feed pump II insert into the storage tank I and storage tank II respectively, and outlet pipes of the feed pump I and the feed pump II are connected to a feed pipe I and a feed pipe II respectively.

3 Claims, 1 Drawing Sheet

(56) References Cited

U.S. PATENT DOCUMENTS

| | | | | |
|---|---|---|---|---|
| 2011/0193398 | A1* | 8/2011 | Meier | E21D 20/021 299/29 |
| 2012/0097755 | A1* | 4/2012 | Nickel | E21D 11/105 239/8 |
| 2013/0330467 | A1* | 12/2013 | Bond | E21D 11/381 427/8 |
| 2016/0263822 | A1* | 9/2016 | Boyd, IV | B33Y 10/00 |

* cited by examiner

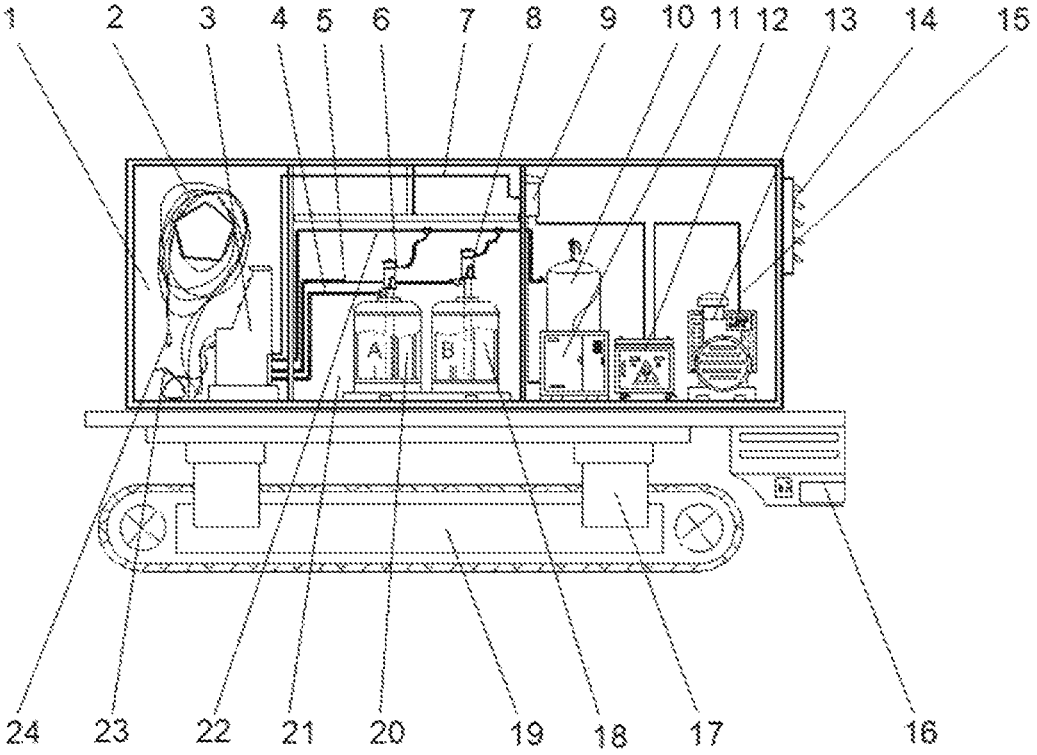
1
2
3
4
5
6
7
8
9
10
11
12
13
14
15
A
B
24
23
22
21
20
19
18
17
16

TRACK-TYPE JET GROUTING INTEGRATED SYSTEM

CROSS REFERENCE OF RELATED APPLICATION

The present invention claims priority under 35 U.S.C. 119(a-d) to CN 201910818542.2, filed Aug. 30, 2019.

BACKGROUND OF THE PRESENT INVENTION

Field of Invention

The present invention relates to the technical fields of reinforcement and seepage prevention of infrastructures like transportation, water conservancy, mining, to buildings and so on, and it provides a track-type jet grouting integrated system.

Description of Related Arts

In recent years, the two-component polyurethane polymer grouting materials with the self-expanding property and the corresponding high-pressure injection technology are developing rapidly all over the world, and they have become one of the Is hot topics in the field of chemical grouting. They have been widely used in reinforcement and seepage prevention of infrastructures of transportation, water conservancy, mines, buildings and so on. The nature of this method is to inject the two-component polymer material into fractures (pores) of the rock mass and by virtue of the characteristics of rapid expansion and solidification of the polymer material after chemical reaction, the rock fractures can be filled. As a result, the goal of filling the gap, sealing the leakage channel and preventing and controlling the water damage can be achieved. Currently, the conventional jet grouting technique involves a vehicle to transport a jet grouting machine to the construction site. The grouting materials always occupy a vehicle for transportation and storage. At the same time, the power needed is taken from the end of the power supply. Furthermore, the grouting materials are manually fed, which is always influenced by the manual labor, resulting in the low working efficiency. The current jet grouting method requires multiple dedicated vehicles to work at the same time, and the working environment is very harsh. In the field, especially muddy and uneven roads, these will greatly affect the travel of shotcrete vehicles and seriously affect the construction progress.

SUMMARY OF THE PRESENT INVENTION

Aiming to overcome the shortcomings of low working efficiency of the conventional jet grouting machines the present invention provides a track-type jet grouting integrated system.

Accordingly, in order to accomplish the above objects, the present invention provides:

a track-type jet grouting integrated system, comprising: a proportioner working bin (1), a storage bin (21), a power bin (15), and load-bearing legs (17). Bottom sections of the load-bearing legs (17) are equipped with a track chassis (19) for moving, and the track chassis (19) is electrically connected to a track controller (16); the storage bin (21) is made of two storage tanks, a storage tank I (20) and a storage tank II (18), for storing different raw materials; a feed pump I (6) is installed on a top of the storage tank I (20), and a feed pump II (8) is installed on a top of the storage tank II (18); inlet pipes of the feed pump I (6) and the feed pump II (8) are inserted into the storage tank I (20) and storage tank II (18), respectively; and outlet pipes of the feed pump I (6) and the feed pump II (8) are connected to a feed pipe I (4) and a feed pipe II (5), respectively; a slurry proportioner (3) is mounted inside the proportioner working bin (1), and both the feed pipe I (4) and the feed pipe II (5) are connected to the slurry proportioner (3); an outlet (2) of the slurry proportioner (3) is connected to a spray head (24), and an air nozzle (23) is provided beside the spray head (24).

A generator (13), a transformer (12), a gas storage tank (10), a power distribution box (9) and a screw air compressor (11) are integrated in the power bin (15); the screw air compressor (11) is connected to the gas storage tank (10); the gas storage tank (10) is connected to the feed pump I (6), the feed pump II (8) and the slurry proportioner (3) in sequence; the generator (13) is connected to the transformer (12); the transformer (12) is connected to the power distribution box (9); the power distribution box (9) is connected to the feed pump I (6), the feed pump II (8), the screw air compressor (11), and the slurry proportioner (3); the air nozzle (23) is connected to the gas storage tank (10).

An exhaust fan (14) is provided outside the power bin (15), and the exhaust fan (14) is connected to the power distribution box (9) through a cable (7).

Beneficial effect of the present invention is as follows. Compared with the prior techniques, the present invention improves the limitation on the construction environment of the conventional jet grouting equipment during working by providing the track chassis and the track controller, which ensures the normal operation of the machines even on the muddy or uneven roads. Furthermore, the slurry proportioner is used for fine proportion, electric power and aerodynamics are highly integrated, and a high-pressure mixing function is adopted. The whole system presented in this invention is unique in the design and has a compact structure, reliable performance and simple to operate, and it can easily reach the construction site autonomously. The present invention provides a reliable whole jet grouting system for grouting technology and it has been successfully used in water conservancy repairing and anti-seepage wall projects, showing strong practicality and irreplaceability.

BRIEF DESCRIPTION OF THE DRAWINGS

FIGURE is a structural view of the present invention.

Element reference: 1: Proportioner working bin, 2: Outlet, 3: Slurry proportioner, 4: Feed pipe I, 5: Feeding pipe II, 6: Feed pump I, 7: Cable, 8: Feed pump II, 9: Power distribution box, 10: Gas storage tank, 11: Screw air compressor, 12: Transformer, 13: Generator, 14: Exhaust fan, 15: Power bin, 16: Track controller, 17: Load-bearing leg, 18: Storage tank II, 19: Track chassis, 20: Storage tank I, 21: Storage bin, 22: Air pipe, 23: Air nozzle, 24: Spray head.

DETAILED DESCRIPTION OF THE PREFERRED EMBODIMENT

Referring to the FIGURE, a track-type shotcrete integrated system is shown,

The present invention provides a track-type jet grouting integrated system, comprising: a proportioner working bin 1, a storage bin 21, a power bin 15, and load-bearing legs 17. Bottom sections of the load-bearing legs 17 are equipped with a track chassis 19 for moving, and the track chassis 19 is electrically connected to a track controller 16; the storage bin 21 is made of two storage tanks, a storage tank 120 and a storage tank II 18, for storing different raw materials; a feed pump 16 is installed on a top of the storage tank 120, and a feed pump II 8 is installed on a top of the storage tank II 18; inlet pipes of the feed pump I 6 and the feed pump II 8 are inserted into the storage tank I 20 and storage tank II 18, respectively; and outlet pipes of the feed pump I 6 and the feed pump II 8 are connected to a feed pipe I 4 and a feed pipe II 5, respectively; a slurry proportioner 3 is mounted inside the proportioner working bin 1, and both the feed pipe I 4 and the feed pipe II 5 are connected to the slurry proportioner 3; an outlet 2 of the slurry proportioner 3 is connected to a spray head 24, and an air nozzle 23 is provided beside the spray head 24.

A generator 13, a transformer 12, a gas storage tank 10, a power distribution box 9 and a screw air compressor 11 are integrated in the power bin 15; the screw air compressor 11 is connected to the gas storage tank 10; the gas storage tank 10 is connected to the feed pump I 6, the feed pump II 8 and the slurry proportioner 3 in sequence; the generator 13 is connected to the transformer 12; the transformer 12 is connected to the power distribution box 9; the power distribution box 9 is connected to the feed pump I 6, the feed pump II 8, the screw air compressor 11, and the slurry proportioner 3; the air nozzle 23 is connected to the gas storage tank 10.

An exhaust fan 14 is provided outside the power bin 15, and the exhaust fan 14 is connected to the power distribution box 9 through a cable 7.

The working process of the present invention is as follows:

(1) turning on the generator 13 and the power can be available when it runs normally;

(2) turning on a power supply switch on the generator 13, so that the generator 13 can supply power to the screw air compressor 11, the transformer 12, the slurry proportioner 3, and the exhaust fan 14;

(3) turning on the electric switch of the screw air compressor 11, so that the screw air compressor 11 can work and supply air to the feed pump I 6, the feed pump II 8 and the spray head 24;

(4) turning on the power supply switch of the slurry proportioner 3 to start the slurry ratio meter 3, and setting proportion parameters of each raw material for the slurry proportioner 3 to make it work normally;

(5) locating the grouting position and positioning the spray head 24 at the suitable position;

(6) starting the slurry proportioner 3, so that the feed pump I 6 and the feed pump II 8 start to transport two different raw materials to the slurry proportioner 3; wherein the materials are heated by the slurry proportioner 3 and then conveyed to one mixing chamber of the spray head 24 for spiral high pressure mixing by in the mixing chamber before spraying; and (7) after the above steps (1) to (6), if necessary, cleaning the track-type shotcrete integrated system by blowing with the air nozzle 23, so as to keep the system clean and free of dust.

The above is only a preferred embodiment of the present invention. Those in the art may apply several changes and improvements without departing from such principles. Therefore, this invention includes all modifications encompassed within the spirit, as such modifications will not affect the effectiveness of the implementation of the present invention and the practicability of the patent.

What is claimed is:

1. A track-type jet grouting integrated system, comprising: a proportioner working compartment (1), a storage compartment (21), a power compartment (15), and load-bearing legs (17), wherein bottom sections of the load-bearing legs (17) are equipped with a track chassis (19) for moving, and the track chassis (19) is electrically connected to a track controller (16); the storage compartment (21) is made of two storage tanks, a storage tank I (20) and a storage tank II (18), for storing different raw materials; a feed pump I (6) is installed on a top of the storage tank I (20), and a feed pump II (8) is installed on a top of the storage tank II (18); inlet pipes of the feed pump I (6) and the feed pump II (8) are inserted into the storage tank I (20) and storage tank II (18), respectively; and outlet pipes of the feed pump I (6) and the feed pump II (8) are connected to a feed pipe I (4) and a feed pipe II (5), respectively; a slurry proportioner (3) is mounted inside the proportioner working compartment (1), and both the feed pipe I (4) and the feed pipe II (5) are connected to the slurry proportioner (3); an outlet (2) of the slurry proportioner (3) is connected to a spray head (24), and an air nozzle (23) is provided beside the spray head (24) for cleaning the track-type jet grouting integrated system by blowing with the air nozzle 23;

wherein during operation, the feed pump I (6) and the feed pump II (8) transport the two different raw materials to the slurry proportioner (3), in such a manner that the two different raw materials are heated by the slurry proportioner (3) and then conveyed to one mixing chamber of the spray head (24) for spiral high pressure mixing by in the mixing chamber before spraying.

2. The track-type shotcrete integrated system, as recited in claim 1, wherein a generator (13), a transformer (12), a gas storage tank (10), a power distribution box (9) and a screw air compressor (11) are integrated in the power compartment (15); the screw air compressor (11) is connected to the gas storage tank (10); the gas storage tank (10) is connected to the feed pump I (6), the feed pump II (8) and the slurry proportioner (3) in sequence; the generator (13) is connected to the transformer (12); the transformer (12) is connected to the power distribution box (9); the power distribution box (9) is connected to the feed pump I (6), the feed pump II (8), the screw air compressor (11), and the slurry proportioner (3);

the air nozzle (23) is connected to the gas storage tank (10).

3. The track-type shotcrete integrated system, as recited in claim 1, wherein an exhaust fan (14) is provided outside the power compartment (15), and the exhaust fan (14) is connected to the power distribution box (9) through a cable (7).

* * * * *